US006935416B1

(12) United States Patent
Tsunoda et al.

(10) Patent No.: US 6,935,416 B1
(45) Date of Patent: Aug. 30, 2005

(54) HEAT EXCHANGER

(75) Inventors: Tadashi Tsunoda, Wako (JP); Hidemi Kimura, Wako (JP); Hideichi Yamamura, Wako (JP); Tetsuya Ogawa, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/451,599

(22) PCT Filed: Dec. 20, 2001

(86) PCT No.: PCT/JP01/11194

§ 371 (c)(1),
(2), (4) Date: Dec. 17, 2003

(87) PCT Pub. No.: WO02/052214

PCT Pub. Date: Jul. 4, 2002

(30) Foreign Application Priority Data

Dec. 25, 2000 (JP) ..... 2000-393030
Dec. 25, 2000 (JP) ..... 2000-393031

(51) Int. Cl.[7] ..... F28F 3/04
(52) U.S. Cl. ..... 165/166; 165/DIG. 358
(58) Field of Search ..... 165/165–167, 165/DIG. 358

(56) References Cited

U.S. PATENT DOCUMENTS 3,291,206 A * 12/1966 Nicholson ..... 165/166
3,507,115 A * 4/1970 Wisoka ..... 165/166
3,613,782 A * 10/1971 Mason et al. ..... 165/166
3,818,984 A * 6/1974 Nakamura et al. ..... 165/166
3,831,374 A 8/1974 Nicita
4,263,966 A * 4/1981 Ostbo ..... 165/166
4,263,967 A * 4/1981 McNab et al. ..... 165/166
4,527,622 A * 7/1985 Weber ..... 165/166
4,550,773 A * 11/1985 Martin ..... 165/166

(Continued)

FOREIGN PATENT DOCUMENTS

JP 59-229193 12/1984

(Continued)

*Primary Examiner*—Teresa J. Walberg
(74) *Attorney, Agent, or Firm*—Squire, Sanders & Dempsey L.L.P.

(57) ABSTRACT

A heat exchanger is provided in which second heat transfer plates (42) and first heat transfer plates (not illustrated) are alternately superimposed so as to form high pressure fluid passages (63) and low pressure fluid passages (not illustrated). The high pressure fluid passages (63) include inlet fluid passages (65*a*, 65*b*) defined by inlet ridges (50*a* to 50*c*) extending from a compressed air inlet (19), and main fluid passages (64) defined by a plurality of main ridges (49) extending parallel to each other in the longitudinal direction of the second heat transfer plates (42) so as to be perpendicular to the inlet fluid passages (65*a*, 65*b*). The two inlet fluid passages (65*a*, 65*b*) have different widths (Wa, Wb), and gaps (α, β) are formed between the downstream ends of the two inlet ridges (50*b*, 50*c*) and the upstream ends of the main ridges (49). A high pressure fluid can thereby be uniformly distributed into the main fluid passages (64) connected to the inlet fluid passages (65*a*, 65*b*) of the high pressure fluid passages (63) of the heat exchanger.

9 Claims, 9 Drawing Sheets

U.S. PATENT DOCUMENTS

| | | | | |
|---|---|---|---|---|
| 4,799,539 | A * | 1/1989 | Atkin et al. | 165/166 |
| 5,036,907 | A * | 8/1991 | Leven | 165/166 |
| 5,081,834 | A * | 1/1992 | Darragh | 165/166 |
| 5,855,112 | A | 1/1999 | Bannai et al. | |
| 5,915,469 | A * | 6/1999 | Abramzon et al. | 165/166 |
| 6,438,936 | B1 * | 8/2002 | Ryan | 165/166 |

FOREIGN PATENT DOCUMENTS

| | | |
|---|---|---|
| JP | 62-172978 | 11/1987 |
| JP | 3-79082 | 8/1991 |
| JP | 5-506918 | 10/1993 |
| JP | 7-180929 | 7/1995 |
| JP | 8-145589 | 6/1996 |

* cited by examiner

HEAT EXCHANGER

FIELD OF THE INVENTION

The present invention relates to a heat exchanger having first heat transfer plates and second heat transfer plates alternately superimposed so as to alternately form low pressure fluid passages and high pressure fluid passages between the two heat transfer plates.

BACKGROUND ART

A heat exchanger having fluid passages for a high temperature fluid to flow and fluid passages for a low temperature fluid to flow, the fluid passages being alternately disposed so that heat is exchanged between the high temperature fluid and the low temperature fluid, is already known from, for example, Japanese Utility Model Registration Application Laid-open No. 3-79082, Published Japanese Translation No. 5-506918 of a PCT Application, and U.S. Pat. No. 3,831,374.

In the Japanese Utility Model Registration Application Laid-open No. 3-79082, a large number of gap-maintaining parts are projectingly provided by bending paper partitions at predetermined intervals, the gap-maintaining parts extending parallel to each other, and a plurality of the partitions are alternately superimposed on each other so that the gap-maintaining parts are perpendicular to each other, thus alternately forming fluid passages for a high temperature fluid to flow and fluid passages for a low temperature fluid to flow between adjacent partitions.

The Published Japanese Translation No. 5-506918 of a PCT Application discloses an annular heat exchanger used for a gas turbine engine, in which a large number of involutely curved heat transfer plates are disposed at predetermined intervals between coaxially disposed outer and inner casings, thus alternately forming in the circumferential direction high pressure fluid passages for compressed air to pass and low pressure fluid passages for a combustion gas to pass.

Furthermore, the U.S. Pat. No. 3,831,374 discloses an annular heat exchanger used for a gas turbine engine, in which a large number of heat transfer plates are radially disposed at predetermined intervals between coaxially disposed outer and inner casings, thus alternately forming in the circumferential direction high pressure fluid passages for compressed air to pass and low pressure fluid passages for a combustion gas to pass. The low pressure fluid passages, through which the combustion gas passes from the front to the rear, extend linearly in the axial direction, whereas the high pressure fluid passages, through which the compressed air passes, include a compressed air inlet in a rear part of the outer casing and a compressed air outlet in a front part of the inner casing. The compressed air therefore flows in radially inward via the compressed air inlet, flows axially forward, and flows out radially inward via the compressed air outlet, and the high pressure fluid passages are thus formed in an overall crank shape.

In the arrangement disclosed in the U.S. Pat. No. 3,831,374, compressed air that has flowed from the front to the rear on the outer periphery of the heat exchanger turns radially inward through 90°, flows to the interior of the heat exchanger via the compressed air inlet, further turns toward the front through 90°, and flows toward the front through the high pressure fluid passages within the heat exchanger. Since the compressed air is forced toward the outside of the turn due to the centrifugal force caused by turning through 180°, it is difficult to make the compressed air, after it has turned, flow uniformly in the axially formed high pressure fluid passages within the heat exchanger, and there is a possibility that the heat exchange efficiency might deteriorate.

Furthermore, in a heat exchanger in which low pressure fluid passages and high pressure fluid passages are formed alternately between a large number of heat transfer plates stacked at predetermined intervals, a difference in pressure between a high pressure fluid flowing though the high pressure fluid passages and a low-pressure fluid flowing though the low pressure fluid passages generates a load to push the heat transfer plates toward the low pressure fluid passages, and there is a possibility that deformation will be caused between the heat transfer plates unless a large number of ridges for supporting the load are formed within the low-pressure fluid. On the other hand, it is not particularly necessary to form a ridge for supporting a load within the high pressure fluid passages, and it is sufficient for there to be a spacer-like ridge for maintaining a predetermined width in the high pressure fluid passages.

DISCLOSURE OF THE INVENTION

The present invention has been achieved in view of these circumstances, and it is a first object thereof to enable a high pressure fluid to be uniformly distributed from inlet fluid passages of high pressure fluid passages of a heat exchanger into main fluid passages that are perpendicular to the inlet fluid passages.

Furthermore, with regard to a heat exchanger in which low pressure fluid passages and high pressure fluid passages are alternately formed via a plurality of heat transfer plates, it is a second object of the present invention to reliably prevent, by a simple structure, deformation of the heat transfer plates due to a difference in pressure between the low pressure fluid passages and the high pressure fluid passages.

In order to achieve the first object, in accordance with a first aspect of the present invention, there is proposed a heat exchanger that includes alternately superimposed first heat transfer plates having a plurality of first ridges formed on one side and second heat transfer plates having a plurality of second ridges formed on one side; low pressure fluid passages formed and partitioned by the plurality of first ridges between the one side of the first heat transfer plates and the other side of the second heat transfer plates extend in the longitudinal direction of the first and second heat transfer plates; high pressure fluid passages formed and partitioned by the plurality of second ridges between the one side of the second heat transfer plates and the other side of the first heat transfer plates have main fluid passages defined by main ridges extending in the longitudinal direction of the first and second heat transfer plates, and inlet fluid passages defined by inlet ridges extending in a direction perpendicular to the longitudinal direction of the first and second heat transfer plates; a plurality of the inlet ridges are formed at different intervals, and gaps are formed between the downstream end of the inlet ridges and the upstream end of the main ridges.

In accordance with this arrangement, since the high pressure fluid passages formed and partitioned by the plurality of second ridges between the one side of the second heat transfer plates and the other side of the first heat transfer plates have the main fluid passages defined by the main ridges extending in the longitudinal direction of the first and second heat transfer plates and the inlet fluid passages defined by the inlet ridges extending in a direction perpendicular to the longitudinal direction of the first and second heat transfer plates, the plurality of inlet ridges are formed at different intervals, and the gaps are formed between the downstream end of the inlet ridges and the upstream end of the main ridges, it can compensate for the influence of centrifugal force on the high pressure fluid that forces it toward the outside of the turn when the high pressure fluid flows from the inlet fluid passages into the main fluid passages while turning, thereby equalizing the high pressure fluid flowing through the main fluid passages and enhancing the heat exchange efficiency.

Furthermore, in order to achieve the first object, in accordance with a second aspect of the present invention, in addition to the first aspect, there is proposed a heat exchanger wherein the lengths of a plurality of the main ridges are non-uniform.

In accordance with this arrangement, making the lengths of the plurality of main ridges non-uniform can equalize the high pressure fluid flowing through the main fluid passages more effectively.

Moreover, in order to achieve the first object, in accordance with a third aspect of the present invention, in addition to the first aspect, there is proposed a heat exchanger wherein the high pressure fluid passages further include outlet fluid passages defined by a plurality of outlet ridges extending in a direction perpendicular to the longitudinal direction of the first and second heat transfer plates, the plurality of outlet ridges being connected to the main ridges defining the main fluid passages.

In accordance with this arrangement, since the plurality of outlet ridges extending in the direction perpendicular to the longitudinal direction of the first and second heat transfer plates and defining the outlet fluid passages are connected to the main ridges defining the main fluid passages, the high pressure fluid flowing through the main fluid passages can be smoothly guided to the outlet fluid passages, thereby minimizing the occurrence of pressure loss.

Furthermore, in order to achieve the first object, in accordance with a fourth aspect of the present invention, in addition to the first aspect, there is proposed a heat exchanger wherein the high pressure fluid passages further include outlet fluid passages defined by a plurality of outlet ridges extending in a direction perpendicular to the longitudinal direction of the first and second heat transfer plates, the main fluid passages, which are sandwiched between the inlet fluid passages and the outlet fluid passages, having a substantially parallelogramic shape.

In accordance with this arrangement, since the main fluid passages, which are sandwiched between the inlet fluid passages on the upstream side of the high pressure fluid passages and the outlet fluid passages on the downstream side, have a substantially parallelogramic shape, it is possible to maintain the maximum area of heat transfer with the low pressure fluid passages, thereby improving the heat exchange efficiency.

Moreover, in order to achieve the second object, in accordance with a fifth aspect of the present invention, there is proposed a heat exchanger that includes first heat transfer plates having a plurality of parallel first ridges formed on one side by continuously bending the plates at predetermined intervals and making the bent parts come into intimate contact; and second heat transfer plates having a plurality of second ridges formed on one side of the plates, the number of second ridges being fewer than the number of first ridges, and the first heat transfer plates and the second heat transfer plates being alternately superimposed; low pressure fluid passages are formed and partitioned by the plurality of first ridges between the one side of the first heat transfer plates and the other side of the second heat transfer plates; and high pressure fluid passages are formed and partitioned by the plurality of second ridges between the one side of the second heat transfer plates and the other side of the first heat transfer plates.

In accordance with this arrangement, since the plurality of parallel first ridges are formed on the one side of the first heat transfer plates by continuously bending the plates at predetermined intervals and making the bent parts come into intimate contact, when the low pressure passages are formed by joining the one side of the first heat transfer plates and the other side of the second heat transfer plates, even if the pressure from the high pressure fluid passages on opposite sides of the low pressure fluid passages is applied to the first heat transfer plates and the second heat transfer plates, the pressure can be supported by the plurality of first ridges, thereby preventing the first and second heat transfer plates from deforming. Moreover, since the first ridges are formed by bending the first transfer plates, not only is the cost low, but also they have a high strength since their thickness is twice the thickness of the first transfer plates. On the other hand, since there is no need for the second heat transfer plate second ridges positioned within the high pressure fluid passages to support the pressure, the number of second ridges can be fewer than the number of first ridges without hindrance, thus contributing to reductions in the processing cost and the weight of the second heat transfer plates.

Furthermore, in order to achieve the second object, in accordance with a sixth aspect of the present invention, in addition to the fifth aspect, there is proposed a heat exchanger wherein joining parts formed by bending opposite edges of the first heat transfer plates toward the one side thereof are superimposed on and joined to joining parts formed by bending opposite edges of the second heat transfer plates toward the other side thereof.

In accordance with this arrangement, since the joining parts formed by bending opposite edges of the first heat transfer plates toward the one side thereof are superimposed on and joined to the joining parts formed by bending opposite edges of the second heat transfer plates toward the other side thereof, opposite edges of the high pressure fluid passages defined between the first and second heat transfer plates can be reliably sealed, thereby preventing the high pressure fluid from blowing past.

Moreover, in order to achieve the second object, in accordance with a seventh aspect of the present invention, in addition to the sixth aspect, there is proposed a heat exchanger wherein the first heat transfer plates and the second heat transfer plates are stacked in an annular shape, a front outer ring and a front inner ring are respectively fixed to the radially outer edge and the radially inner edge at the axially front end of the first and second heat transfer plates, a rear outer ring and a rear inner ring are respectively fixed to the radially outer edge and the radially inner edge at the axially rear end of the first and second heat transfer plates, and an outer casing and an inner casing are then joined to the radially outer edge and the radially inner edge respectively of the first and second heat transfer plates so as to provide a seal.

In accordance with this arrangement, since the annularly stacked first and second heat transfer plates are sealed by joining the outer casing and the inner casing to the radially outer edge and the radially inner edge thereof respectively while they are fixed and positioned by means of the four rings, not only is it possible to easily and precisely assemble the heat exchanger having a large number of first and second heat transfer plates, but it is also possible to further reliably prevent, by the outer casing and the inner casing, the high pressure fluid from blowing past from the high pressure fluid passage to the low pressure fluid passage.

Furthermore, in order to achieve the second object, in accordance with an eighth aspect of the present invention, in addition to the seventh aspect, there is proposed a heat exchanger wherein the first heat transfer plates and the second heat transfer plates are involutely curved.

In accordance with this arrangement, since the first heat transfer plates and the second heat transfer plates are involutely curved, the gap between the first and second heat transfer plates can be equalized at all positions in the radial direction of the heat exchanger.

Moreover, in order to achieve the second object, in accordance with a ninth aspect of the present invention, in addition to the eighth aspect, there is proposed a heat exchanger wherein the joining parts of the radially inner edges of the first and second heat transfer plates are made to follow the outer peripheral surface of the inner casing, and the joining parts of the radially outer edges of the first and second heat transfer plates are made to follow the inner peripheral surface of the outer casing.

In accordance with this arrangement, since the joining parts at the edges of the first and second heat transfer plates are made to follow the outer peripheral surface of the inner casing and the inner peripheral surface of the outer casing, the joining parts of the first and second heat transfer plates and the two casings can be joined with high precision without a gap, thereby effectively preventing the high pressure fluid from blowing past.

Furthermore, in order to achieve the second object, in accordance with a tenth aspect of the present invention, in addition to the ninth aspect, there is proposed a heat exchanger wherein the radially inner edges of the first and second heat transfer plates are made perpendicular to the outer peripheral surface of the inner casing.

In accordance with this arrangement, since the radially inner edges of the first and second heat transfer plates are made perpendicular to the outer peripheral surface of the inner casing, not only is it possible to stack the first and second heat transfer plates with high precision, but also the precision of joining to the inner casing can be improved.

Moreover, in order to achieve the second object, in accordance with an eleventh aspect of the present invention, in addition to the fifth aspect, there is proposed a heat exchanger wherein the first heat transfer plates and the second heat transfer plates are made in the form of flat plates and stacked in a rectangular parallelepiped shape.

In accordance with this arrangement, the heat exchanger can be made compact by forming it in a rectangular parallelepiped shape.

BRIEF DESCRIPTION OF THE DRAWINGS

FIG. 1 is a longitudinal cross section of a gas turbine engine; FIG. 2 is a cross section along line 2—2 in FIG. 1; FIG. 3 is a magnified cross section along line 3—3 in FIG. 2; FIG. 4 is a magnified cross section along line 4—4 in FIG. 2; FIG. 5 is a magnified view of part 5 in FIG. 2; FIG. 6 is a magnified view of part 6 in FIG. 2; and FIG. 7 is a cross section along line 7—7 in FIG. 4.

FIG. 8 is a perspective view of a heat exchanger; and FIG. 9 is a view from arrow 9 in FIG. 8.

BEST MODE FOR CARRYING OUT THE INVENTION

The first embodiment of the present invention is explained below by reference to FIG. 1 to FIG. 7.

Figure 1:
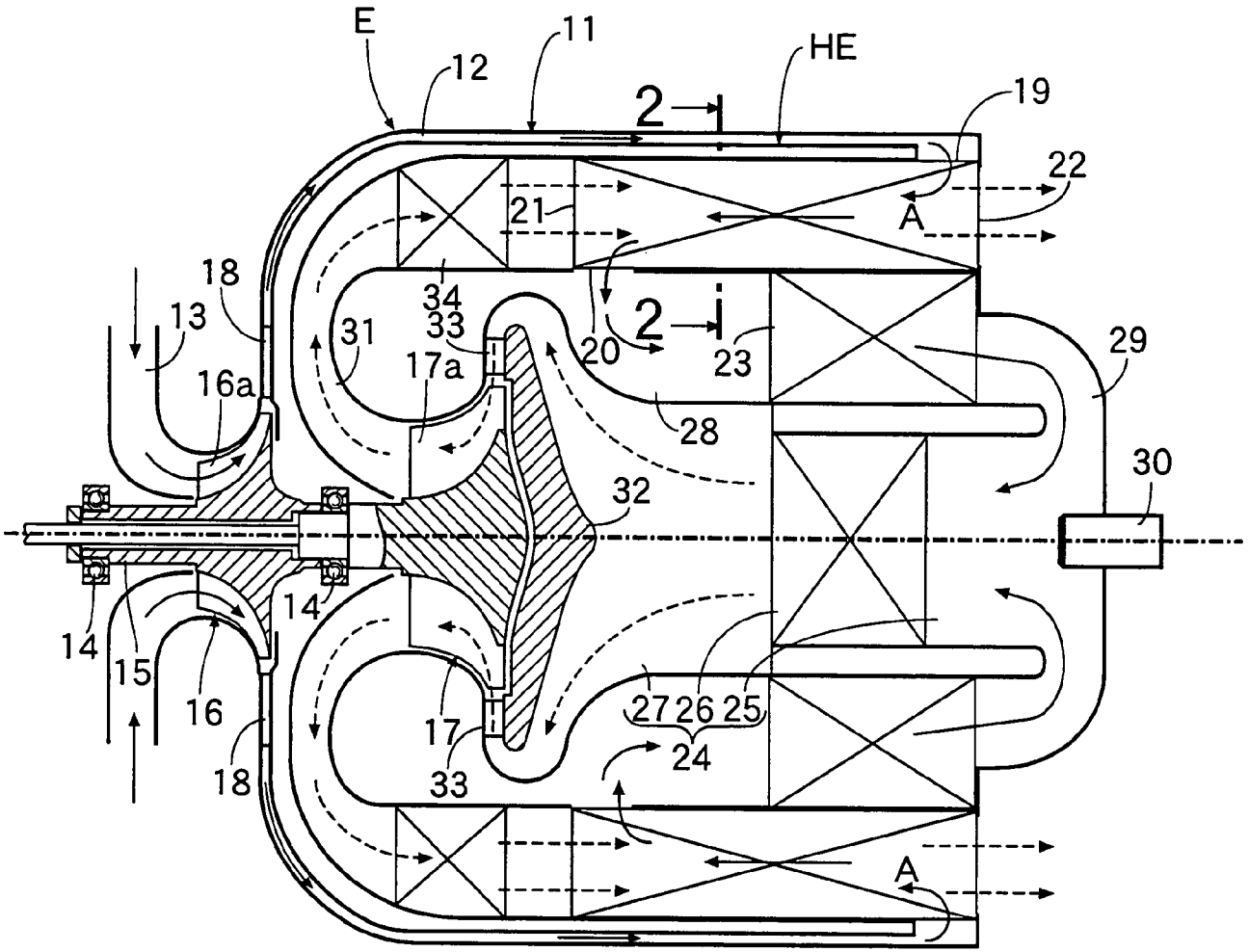
FIG. 1 to FIG. 7 show a first embodiment of the present invention.
Figure 2:
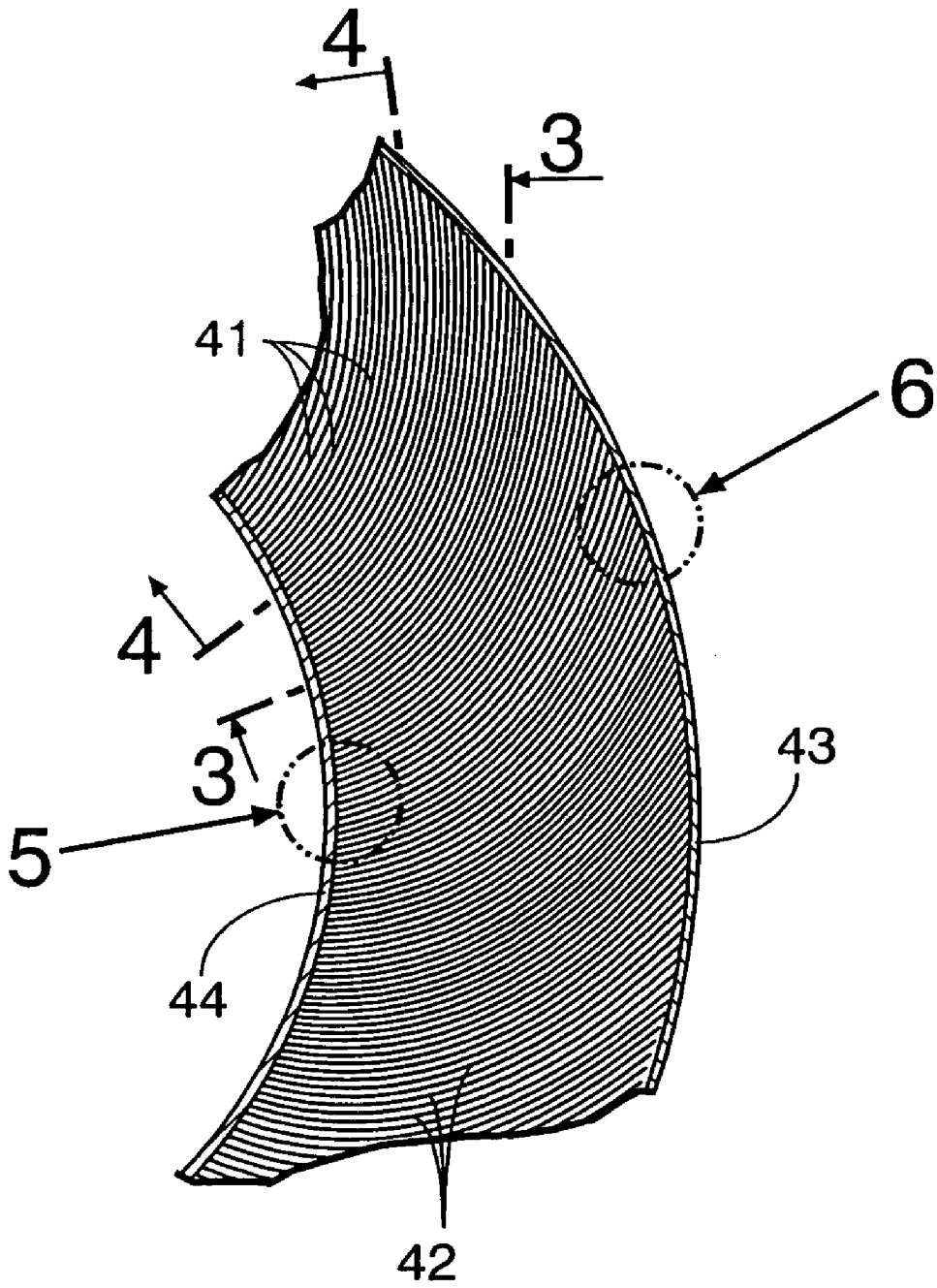

Referring to FIG. 1, an outline explanation is firstly given of the structure of a gas turbine engine E in which a heat-transfer type heat exchanger HE of the present embodiment is mounted.

The gas turbine engine E includes a substantially cylindrical engine casing 11. Formed on the outer periphery of the engine casing 11 is a first compressed air passage 12, to the upstream side of which is connected an intake passage 13 communicating with an air cleaner and a silencer (not illustrated).

A centrifugal compressor wheel 16 and a centrifugal turbine wheel 17 are coaxially and adjacently fixed on a rotating shaft 15 running through the center of the intake passage 13 and supported by a pair of bearings 14 and 14. A plurality of compressor blades 16*a* are radially formed on the outer periphery of the compressor wheel 16 and face the intake passage 13, and a plurality of compressor diffusers 18 are provided in the first compressed air passage 12 at positions directly downstream of the compressor blades 16*a*.

The heat-transfer type heat exchanger HE, which has an annular shape, is disposed at the rear end of the engine casing 11. The heat exchanger HE has a compressed air inlet 19 at an outer peripheral part of the rear end, a compressed air outlet 20 at an inner peripheral part of the front end, a combustion gas inlet 21 at the front end, and a combustion gas outlet 22 at the rear end. Making a comparatively low temperature, high pressure compressed air shown by the solid lines and a comparatively high temperature, low pressure combustion gas shown by the broken lines flow in opposite directions from each other within the heat exchanger HE can maintain a large difference in temperature between the compressed air and the combustion gas along the entire length of the passages, thereby improving the heat exchange efficiency.

Coaxially disposed on the radially inner side of the heat exchanger HE is an annular preheater 23, and coaxially disposed on the radially inner side of the annular preheater 23 is a catalyst type single can combustor 24. The single can combustor 24 includes, from the upstream side to the downstream side, a premixing part 25, a catalytic combustion part 26, and a gas phase combustion part 27, in that order. The compressed air outlet 20 of the heat exchanger HE and the preheater 23 are connected together via a second compressed air passage 28, and the preheater 23 and the premixing part 25 are connected together via a third compressed air passage 29. A fuel injection nozzle 30 is provided in the third compressed air passage 29. Fuel injected through the fuel injection nozzle 30 is mixed uniformly with compressed air in the premixing part 25, and combustion is carried out with a low level of harmful emissions. In this way, employing the single can combustor 24 not only enables catalytic combustion to be carried out, which is difficult with an annular combustor, but also reduces the number of fuel injection nozzles 30, etc., thereby simplifying the structure.

A plurality of turbine blades 17*a* face an upstream part of a combustion gas passage 31 that connects the gas phase combustion part 27 to the combustion gas inlet 21 of the heat exchanger HE, the plurality of turbine blades 17*a* being formed radially on the outer periphery of the turbine wheel 17, and a heat shielding plate 32 and turbine nozzles 33 are provided on a part of the combustion gas passage 31 that is further upstream, the heat shielding plate 32 guiding the combustion gas from the gas phase combustion part 27. Furthermore, disposed in a downstream part of the combustion gas passage 31 is an annular oxidation catalyst 34 for removing harmful components from the combustion gas.

As a result, the air taken in via the intake passage 13 and compressed by the compressor wheel 16 is fed to the heat exchanger HE via the first compressed air passage 12 and there carries out heat exchange with the combustion gas, which is at a high temperature, so as to be heated. The compressed air that has passed through the heat exchanger HE reaches the premixing part 25 via the second compressed air passage 28 and the third compressed air passage 29, and there mixes with the fuel injected via the fuel injection nozzle 30. When starting the gas turbine engine E, since no combustion gas is flowing, the heat exchanger HE cannot function adequately. It is therefore necessary, when starting the engine, to electrically heat the compressed air by energizing the preheater 23 provided between the second and third compressed air passages 28 and 29, thus increasing the temperature of the compressed air to the catalyst activation temperature or higher.

A part of the gas mixture flowing into the single can combustor 24 is burned by a catalytic reaction on contact with a catalyst supported on the catalytic combustion part 26, and the rest of the gas mixture is burned in the gas phase by the heat of the combustion gas in the gas phase combustion part 27. The combustion gas flows into the combustion gas passage 31 thereby driving the turbine wheel 17, further passes through the oxidation catalyst 34 thereby removing harmful components, and is fed to the heat exchanger HE. In this way, when the turbine wheel 17 rotates, its rotational torque is transmitted to the compressor wheel 16 and a driven part (not illustrated) via the rotating shaft 15.

The structure of the heat exchanger HE is now explained by reference to FIG. 2 to FIG. 7.

The annular heat exchanger HE is formed by alternately superimposing a large number of first heat transfer plates 41, which are rectangular metal plates, and a large number of second heat transfer plates 42, which are metal plates having the same external shape as that of the first heat transfer plates 41, and covering the outer peripheral surface thereof with a tubular outer casing 43 and the inner peripheral surface thereof with a tubular inner casing 44.

Figure 3:
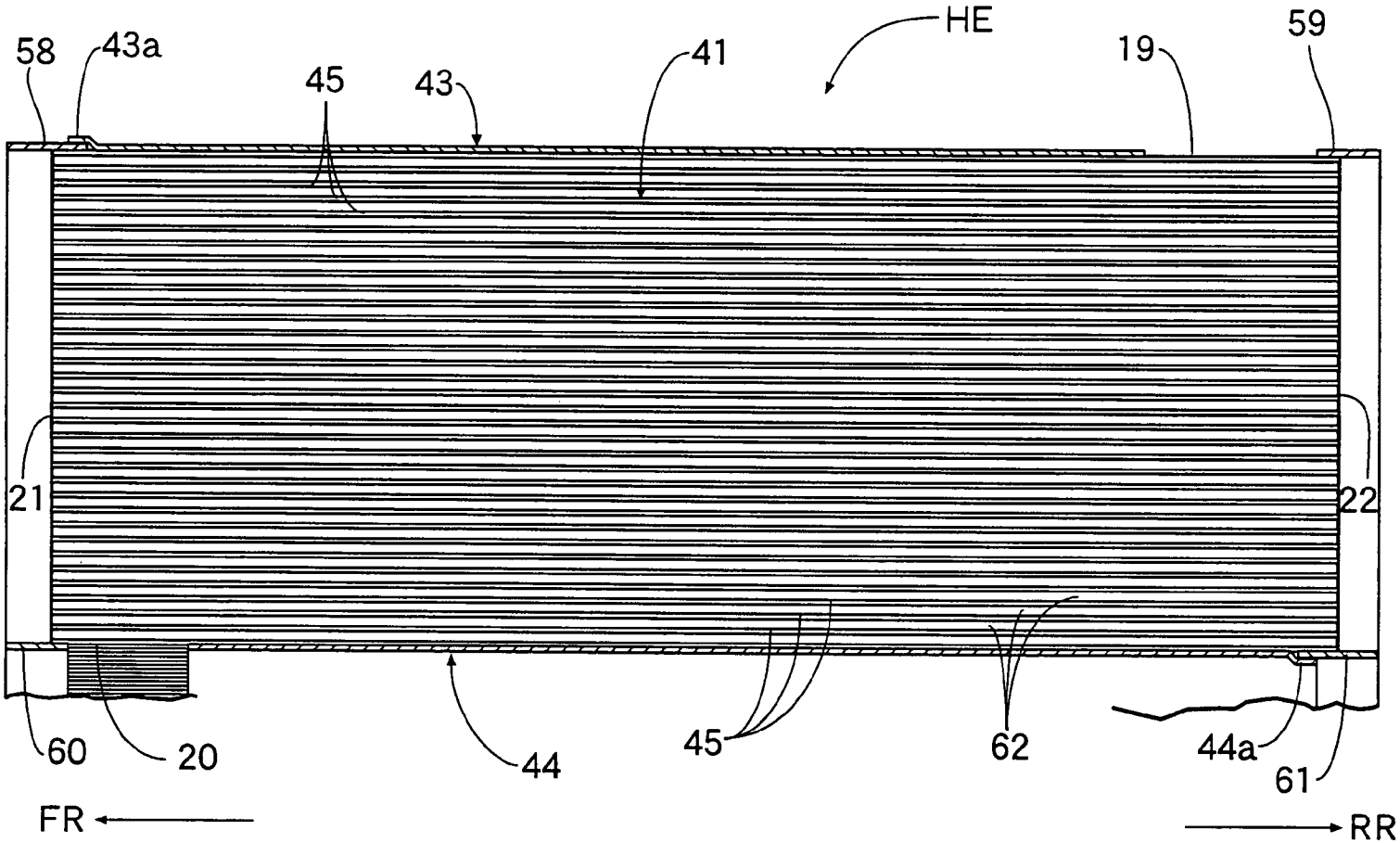
Figure 5:
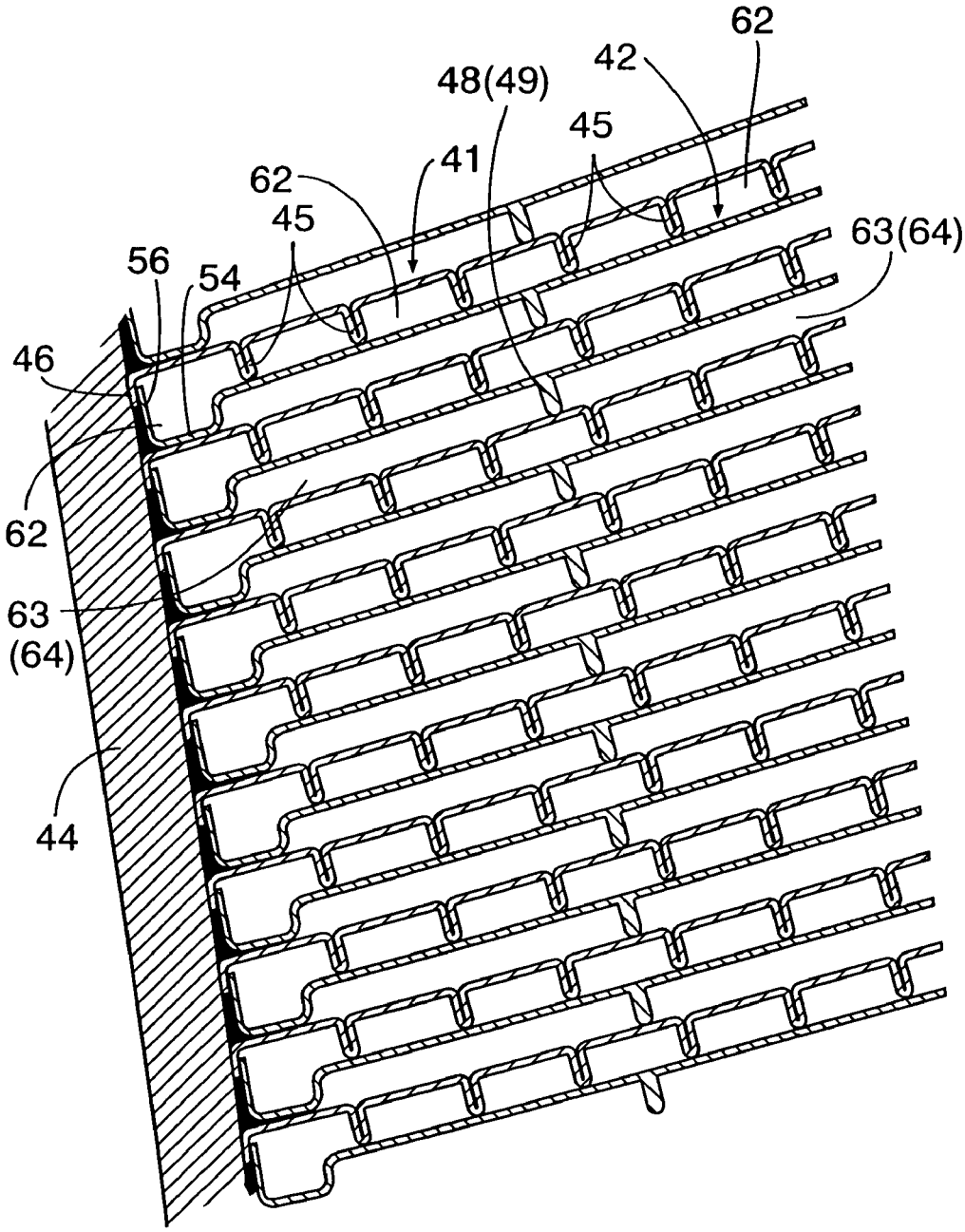
Figure 6:
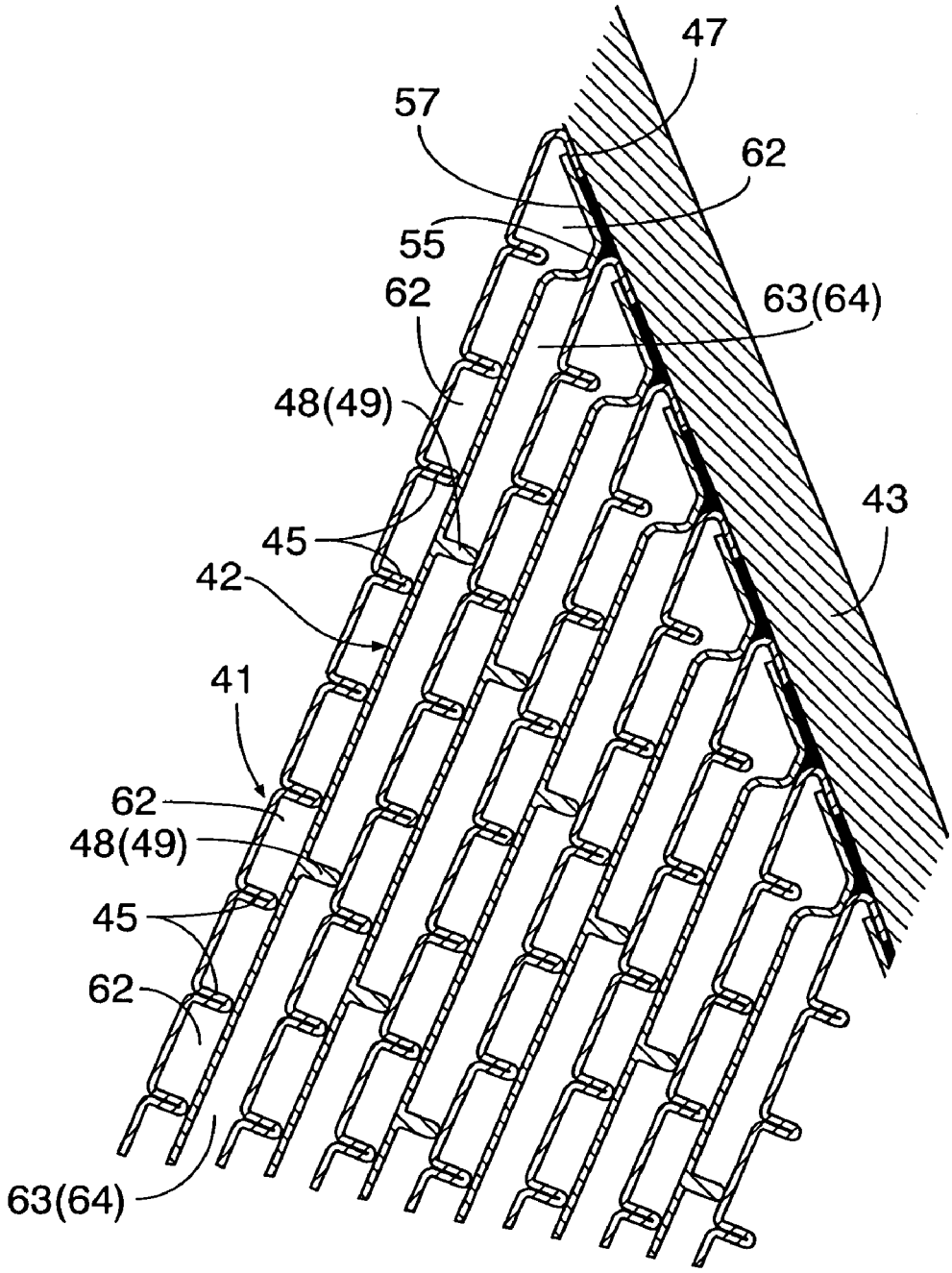
Figure 7:
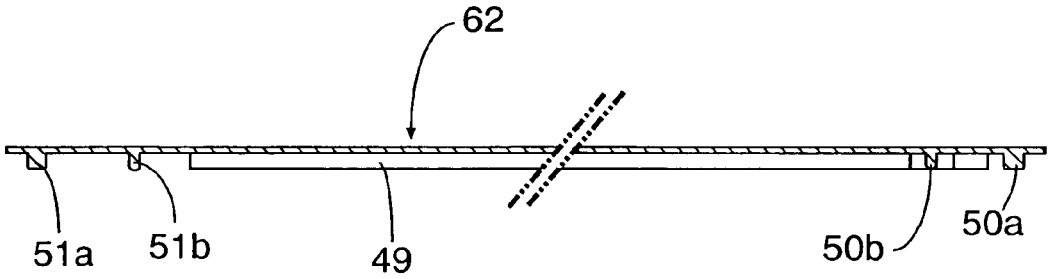

As shown in FIG. 3, FIG. 5 and FIG. 6, the first heat transfer plates 41 are formed by bending a flat metal plate into corrugations parallel to the long edges, and making the bent parts contact each other so as to form, at small intervals in parallel to each other, a large number of first ridges 45 projecting on one side. Formed on an inside edge and an outside edge of the first heat transfer plate 41, corresponding to the inner peripheral part and the outer peripheral part of the annular heat exchanger HE, are joining parts 46 and 47 that are bent toward the one side. The other side of the first heat transfer plate 41, which is joined to the second heat transfer plate 42 is made flat.

Figure 4:
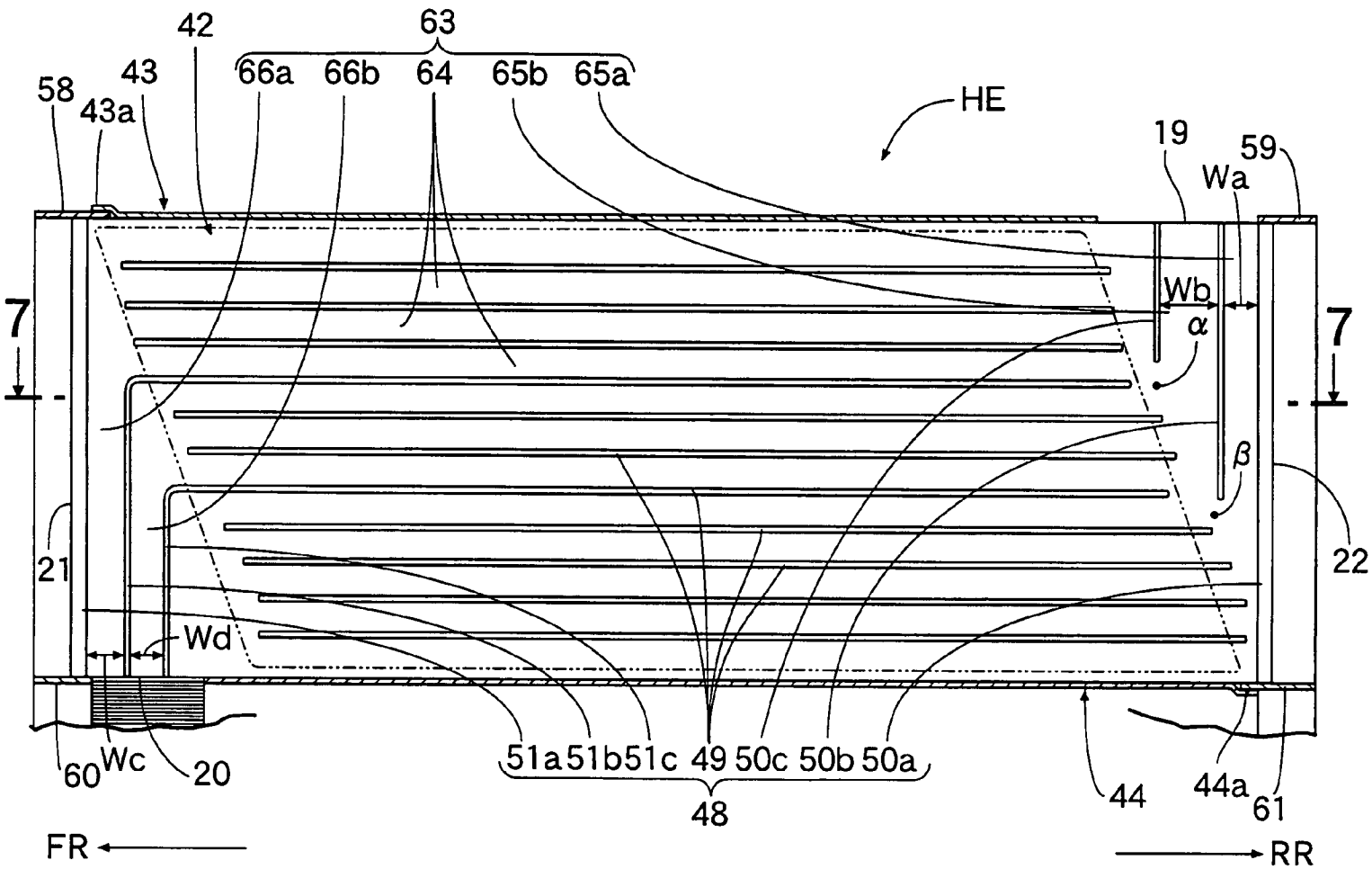

As shown in FIG. 4, FIG. 5 and FIG. 6, the second heat transfer plates 42 are formed by projectingly providing, on one side of a flat metal plate, a plurality of second ridges 48 having a coarser pitch than that of the first ridges 45 of the first heat transfer plate 41. The second ridges 48 include a plurality (11 in the embodiment) of main ridges 49, a plurality (3 in the embodiment) of inlet ridges 50*a*, 50*b*, and 50*c*, and a plurality (3 in the embodiment) of outlet ridges 51*a*, 51*b*, and 51*c*. The main ridges 49 extend parallel to the long edges of the second heat transfer plate 42. The inlet ridges 50*a*, 50*b*, and 50*c* extend parallel to the short edges of the second heat transfer plate 42 from positions facing the compressed air inlet 19 of the annular heat exchanger HE. The outlet ridges 51*a*, 51*b*, and 51*c* extend parallel to the short edges of the second heat transfer plate 42 from positions facing the compressed air outlet 20 of the annular heat exchanger HE. The other side of the second heat transfer plate 42, which is joined to the first heat transfer plate 41, is made flat.

Among the three inlet ridges 50*a*, 50*b*, and 50*c*, the inlet ridge 50*a* at the rear end side of the second heat transfer plate 42 is formed wider than the other two inlet ridges 50*b* and 50*c* in order to enhance the sealability. This is because the other two inlet ridges 50*b* and 50*c* function as partitions to form adjacent passages, whereas the inlet ridge 50*a* serves also as a bank-shaped blocking member for blocking the rear end of the heat exchanger HE. Similarly, among the three outlet ridges 51*a*, 51*b*, and 51*c*, the outlet ridge 51*a* at the front end side of the second heat transfer plate 42 is formed wider than the other two outlet ridges 51*b* and 51*c*, and also serves as a bank-shaped blocking member for blocking the front end of the heat exchanger HE.

With regard to the lengths of the three inlet ridges 50*a*, 50*b*, and 50*c*, the inlet ridge 50*a* at the rear end side of the second heat transfer plate 42 is the longest and has the same length as that of the short edge of the second heat transfer plate 42, and the further from the rear end side of the second heat transfer plate 42, the shorter the length. The lengths of the main ridges 49 are not uniform, and there are gaps $\alpha$ and $\beta$ between the end of the inlet ridge 50*b* and the end of the inlet ridge 50*c*, which are second and third furthest from the rear end side of the second heat transfer plate 42. With regard to the lengths of the three outlet ridges 51*a*, 51*b*, and 51*c*, the outlet ridge 51*a* at the front end side of the second heat transfer plate 42 is the longest and has the same length as that of the short edge of the second heat transfer plate 42, and the further from the front end side of the second heat transfer plate 42, the shorter the is length. The end of the outlet ridge 51*b* and the end of the outlet ridge 51*c*, which are second and third furthest from the front end side of the second heat transfer plate 42, are connected to the ends of the two main ridges 49 and 49 in a smooth arc.

Formed on the inner edge and the outer edge of the second heat transfer plate 42, corresponding to the inner peripheral part and the outer peripheral part of the annular heat exchanger HE, respectively, are projections 54 and 55 bent toward the one side, and joining parts 56 and 57 connected to these projections 54 and 55 and bent toward the other side. The heights of the projections 54 and 55 are set equal to the heights of the second ridges 48. The joining parts 56 and 57 of the second heat transfer plate 42 are superimposed so that parts thereof overlap the inner surfaces of the joining parts 46 and 47 of the first heat transfer plate 41.

If the first heat transfer plates 41 and the second heat transfer plates 42 are disposed radially, the gap between adjacent first and second heat transfer plates 41 and 42 is small in an inner peripheral part of the annular heat exchanger HE, and the gap is large in an outer peripheral part. However, as is clear from FIG. 5 and FIG. 6, involutely curving the first heat transfer plates 41 and the second heat transfer plates 42 can achieve a uniform gap between adjacent first and second heat transfer plates 41 and 42 in the inner peripheral part and the outer peripheral part of the heat exchanger HE. Since the first heat transfer plates 41 and the second heat transfer plates 42 are involutely curved, in the inner peripheral part of the heat exchanger HE, the first and second heat transfer plates 41 and 42 intersect the inner casing 44 substantially perpendicularly, but they intersect the outer casing 43 at an acute angle.

As is clear from FIG. 3 and FIG. 4, the first heat transfer plates 41 and the second heat transfer plates 42, which are alternately superimposed and combined in an annular shape, have a front outer ring 58 and a rear outer ring 59 fitted around the outer periphery of a front part and the outer periphery of a rear part thereof respectively, and have a front inner ring 60 and a rear inner ring 61 fitted into the inner periphery of the front part and the inner periphery of the rear part thereof respectively, so as to position them. The outer casing 43 for covering and sealing the outer peripheral surface of the annularly combined first and second heat transfer plates 41 and 42 has a large diameter part 43*a* at its front end fitted around the outer peripheral surface of the front outer ring 58, and has the compressed air inlet 19 opened between its rear end and the rear outer ring 59. Furthermore, the inner casing 44 for covering and sealing the inner peripheral surfaces of the first and second heat transfer plates 41 and 42 has a large diameter part 44*a* at its rear end fitted onto the inner peripheral surface of the rear inner ring 61, and has the compressed air outlet 20 opened between its front end and the front inner ring 60.

In this way, since, after the first heat transfer plates 41 and the second heat transfer plates 42 have been united by means of the front outer ring 58, the rear outer ring 59, the front inner ring 60, and the rear inner ring 61, the outer casing 43 and the inner casing 44 are joined to the outer peripheral surface and the inner peripheral surface thereof, not only is it possible to easily assemble the heat exchanger HE having the large number of first heat transfer plates 41 and second heat transfer plates 42, but it is also possible to improve the precision of assembly. Moreover, joining the outer casing 43 and the inner casing 44 can more effectively prevent the compressed air from blowing past the outer peripheral surface and the inner peripheral surface of the first heat transfer plates 41 and the second heat transfer plates 42.

The first heat transfer plates 41, the second heat transfer plates 42, the front outer ring 58, the rear outer ring 59, the front inner ring 60, the rear inner ring 61, the outer casing 43, and the inner casing 44 are joined by brazing. As is clear from FIG. 5, in a section where the first heat transfer plates 41 and the second heat transfer plates 42 are brazed to the inner casing 44, the narrow joining part 46 of the first heat transfer plate 41 is superimposed so as to overlap a part of the outer surface of the wide joining part 56 of the second heat transfer plate 42, and a major part of the joining part 56 of the second heat transfer plate 42 faces the outer peripheral surface of the inner casing 44 across a gap corresponding to the thickness of the first heat transfer plate 41. It is therefore possible to reliably carry out brazing by making a brazing material, shown by the solid black areas, flow into the gap, thus ensuring a high assembly strength for the heat exchanger HE and thereby preventing the compressed air and combustion gas from blowing past.

Similarly, as is clear from FIG. 6, in a section where the first heat transfer plates 41 and the second heat transfer plates 42 are brazed to the outer casing 43, the narrow joining part 47 of the first heat transfer plate 41 is superimposed so as to overlap a part of the outer surface of the wide joining part 57 of the second heat transfer plate 42, and a major part of the joining part 57 of the second heat transfer plate 42 faces the inner peripheral surface of the outer casing 43 across a gap corresponding to the thickness of the first heat transfer plate 41. It is therefore possible to reliably carry out brazing by making a brazing material, shown by the solid black, flow into the gap, thus ensuring a high assembly strength of the heat exchanger HE and thereby preventing the compressed air and combustion gas from blowing past.

In particular, since the inner edges of the involutely curved first and second heat transfer plates 41 and 42 intersect the outer peripheral surface of the inner casing 44 substantially perpendicularly, it is possible to stack the first heat transfer plates 41 and the second heat transfer plates 42 with good precision, and it is possible to enhance the precision of brazing and effectively prevent the compressed air from blowing past from high pressure fluid passages 63 to low pressure fluid passages 62, which will be described below.

As is clear from FIG. 3, in order to provide a connection between the combustion gas inlet 21 and the combustion gas outlet 22, a plurality of the linear and parallel low pressure fluid passages 62 are defined by the first ridges 45 between the one side of the first heat transfer plates 41, from which the first ridges 45 project, and the other flat side of the second heat transfer plates 42.

As is clear from FIG. 4, in order to provide a connection between the compressed air inlet 19 and the compressed air outlet 20, the high pressure fluid passages 63 are formed between the one side of the second heat transfer plate 42, from which the second ridges 48 project, and the other flat side of the first heat transfer plate 41. The high pressure fluid passages 63 are formed in a crank shape so as to have inlet fluid passages 65*a* and 65*b*, main fluid passages 64, and outlet fluid passages 66*a* and 66*b*, which are partitioned by the second ridges 48. That is, formed between the inlet ridges 50*a*, 50*b*, and 50*c* are the inlet fluid passages 65*a* and 65*b* extending radially inward from the compressed air inlet 19, formed between the main ridges 49 are the axially extending main fluid passages 64, and formed between the outlet ridges 51*a*, 51*b*, and 51*c* are the outlet fluid passages 66*a* and 66*b* extending radially outward from the compressed air outlet 20.

Since the main fluid passages 64 of the high pressure fluid passages 63 for exchanging heat with the low pressure fluid passages 62 are formed in a substantially parallelogramic shape as shown by the double dotted broken line in FIG. 4, it is possible to maximize the heat transfer area (the area of the main fluid passages 64) for heat exchange while ensuring sufficient space for the inlet fluid passages 65*a* and 65*b* and the outlet fluid passages 66*a* and 66*b*, thereby improving the heat exchange efficiency.

In this way, the comparatively high temperature, low pressure combustion gas that is generated in the single can combustor 24 and drives the turbine wheel 17 flows through the combustion gas passage 31, passes through the low pressure fluid passages 62 from the combustion gas inlet 21 at the front end of the heat exchanger HE, and is discharged through the combustion gas outlet 22 at the rear end of the heat exchanger HE. On the other hand, the comparatively low temperature, high pressure compressed air compressed by the compressor wheel 16 flows rearward in the first compressed air passage 12 formed on the outer periphery of the gas turbine engine E, then flows from the compressed air inlet 19 formed in the outer peripheral part at the rear end of the heat exchanger HE into the inlet fluid passages 65*a* and 65*b* while changing its direction radially inward through 90°, and flows forward into the main fluid passages 64 while changing its direction through 90°. The compressed air further changes its direction radially inward through 90° at the front end of the main fluid passages 64, and is discharged from the compressed air outlet 20 formed in the inner peripheral part at the front end of the heat exchanger HE into the second compressed air passage 28.

In this way, the heat exchanger HE includes the low pressure fluid passages 62 and the high pressure fluid passages 63 formed alternately between the first heat transfer plates 41 and the second heat transfer plates 42, the high temperature combustion gas flows in the low pressure fluid passages 62 from the front to the rear, the low temperature compressed air flows in the high pressure fluid passage from the rear to the front, and it is therefore possible to maintain a large difference in temperature between the combustion gas and the compressed air along the whole length in the axial direction of the heat exchanger HE by implementing a so-called cross-flow state, thereby improving the heat exchange efficiency.

The compressed air flows rearward in the first compressed air passage 12, turns through 180° (see arrow A in FIG. 1) in the inlet fluid passages 65*a* and 65*b* of the heat exchanger HE, and then flows forward in the main fluid passages 64 of the heat exchanger HE. Since the centrifugal force acting on the compressed air during the turn forces it toward the outside of the turn, among the large number of main fluid passages 64 formed parallel to the axial direction, there is a tendency for an increased amount of compressed air to be supplied to the main fluid passages 64 on the outside of the turn, that is, the main fluid passages 64 on the radially inner side of the heat exchanger HE, whereas a decreased amount of compressed air is supplied to the main fluid passages 64 on the radially outer side of the heat exchanger HE.

However, in accordance with the present embodiment, among the inlet fluid passages 65*a* and 65*b* defined by the three inlet ridges 50*a*, 50*b*, and 50*c*, a width Wa of the inlet fluid passage 65*a* on the outside of the turn is made narrow, a width Wb of the inlet fluid passage 65*b* on the inside of the turn is made wide, there are gaps α and β between the ends of the main ridges 49 and the ends of the inlet ridge 50*b* and the inlet ridge 50*c*, which are second and third furthest from the rear end side of the second heat transfer plate 42, the lengths of the main ridges 49 are non-uniform, and the positions of the front and rear ends of the main ridges 49 are adjusted in the longitudinal direction. It is therefore possible to equalize the amounts of compressed air flowing into all the main fluid passages 64 regardless of the position in the radial direction.

That is, narrowing the width Wa of the inlet fluid passage 65*a* on the outside of the turn, where the flow rate of the compressed air tends to increase due to the centrifugal force, and widening the width Wb of the inlet fluid passage 65*b* on the inside of the turn, where the flow rate of the compressed air tends to decrease, can equalize the amounts of compressed air distributed to the main fluid passages 64 from the inlet fluid passages 65*a* and 65*b*. Moreover, since the downstream ends of the two inlet ridges 50*b* and 50*c* are not connected to the upstream ends of the main ridges 49 and 49 but have the gaps α and β formed therebetween, and the positions of the front and rear ends of the main ridges 49 are adjusted in the longitudinal direction, the amounts of compressed air distributed to the main fluid passages 64 can be more effectively equalized.

On the other hand, since two of the main ridges 49 and 49 are smoothly connected to the two outlet ridges 51*b* and 51*c* and, moreover, the widths Wc and Wd of the two outlet fluid passages 66*a* and 66*b* are set so as not to be identical, the compressed air flowing through the main fluid passages 64 can be smoothly guided to the outlet fluid passages 66*a* and 66*b*, thereby minimizing the occurrence of pressure loss.

Since the main fluid passages 64, the inlet fluid passages 65*a* and 65*b*, and the outlet fluid passages 66*a* and 66*b* are arranged as above, the compressed air can be made to flow uniformly and smoothly along the whole length of the high pressure fluid passages 63, which are bent into an overall crank shape.

Furthermore, since the pressure of the compressed air flowing through the high pressure fluid passages 63 is higher than the pressure of the combustion gas flowing through the low pressure fluid passages 62, the first heat transfer plate 41 and the second heat transfer plate 42 defining the low pressure fluid passage 62 between adjacent high pressure fluid passages 63 and 63 are exposed to loads that move them close to each other due to the pressure difference between the compressed air and the combustion gas. However, since the large number of first ridges 45 projectingly provided with a small pitch on the one side of the first heat transfer plate 41 support the other side of the second heat transfer plate 42, it is possible to reliably prevent the first heat transfer plate 41 and the second heat transfer plate 42 from deforming due to the pressure difference between the compressed air and the combustion gas. Moreover, since the first ridges 45 are formed by continuously bending the first heat transfer plate 41 at predetermined intervals and making the bent parts come into intimate contact with each other, the plate thickness of the bent parts doubles, thus not only enhancing the rigidity for supporting the pressure difference, but also greatly reducing the processing cost.

Since the first heat transfer plate 41 and the second heat transfer plate 42 defining the high pressure fluid passage 63 between adjacent low pressure fluid passages 62 and 62 are exposed to loads that move them away from each other due to the pressure difference between the compressed air and the combustion gas, even when a large pitch is set for the second ridges 48 on the second heat transfer plate 42, the second ridges 48 being disposed within the high pressure fluid passage 63, there is no problem in terms of strength. It is therefore sufficient for the second ridges 48 to be formed with a pitch that maintains the gap between the first heat transfer plate 41 and the second heat transfer plate 42, thereby contributing to reductions in the processing cost and the weight of the second heat transfer plate 42.

Furthermore, since the projections 54 and 55 projectingly provided on the inner edge and the outer edge of the one side of the second heat transfer plate 41 are made to abut against the other side of the first heat transfer plate 42, the gaps at the inner edge and the outer edge between the first and second heat transfer plates 41 and 42 can be made to match a set value without a special spacer and the like.

Figure 8:
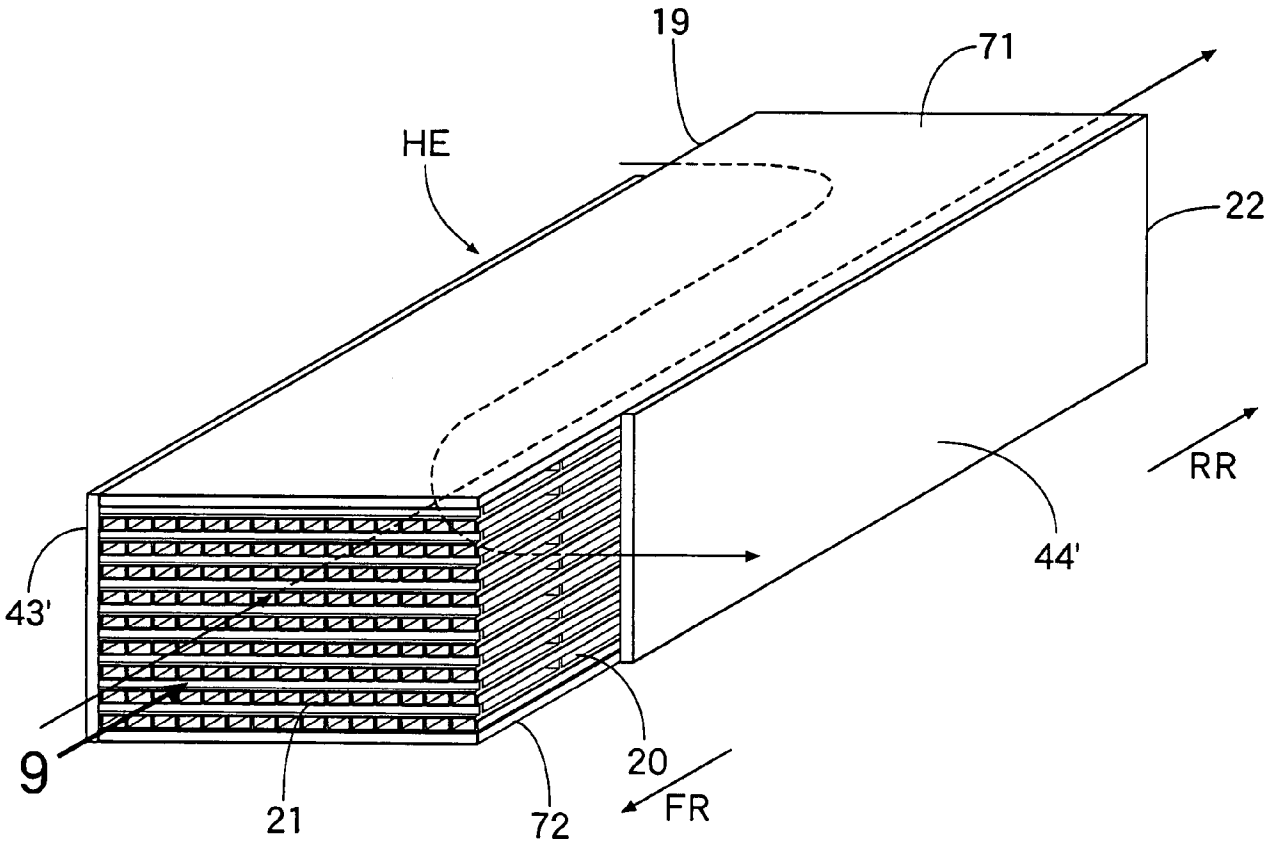
FIG. 8 and FIG. 9 show a second embodiment of the present invention.
Figure 9:
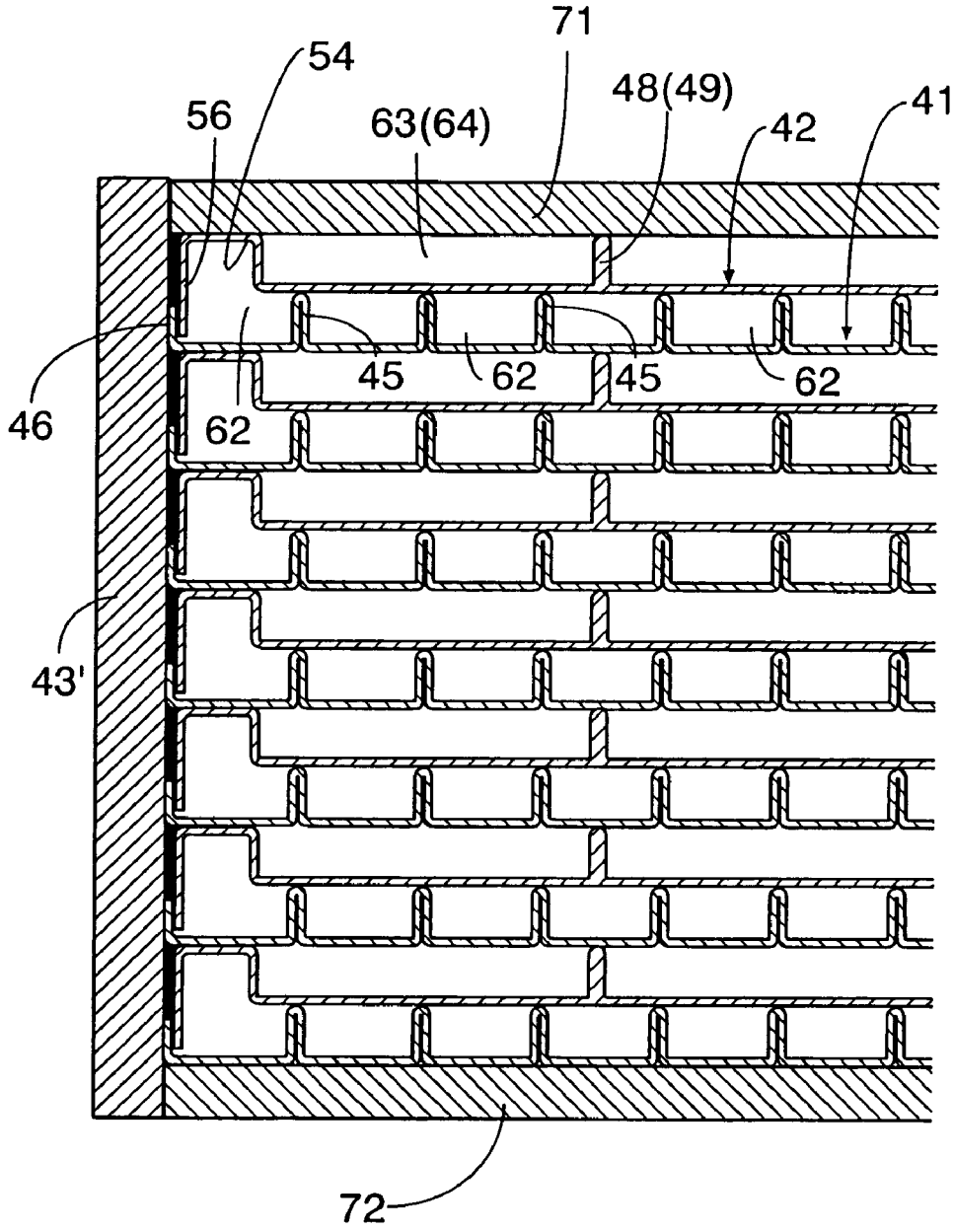

FIG. 8 and FIG. 9 show the second embodiment of the present invention, FIG. 8 is a perspective view of a heat exchanger, and FIG. 9 is a view from arrow 9 in FIG. 8.

Whereas the heat exchanger HE of the above-mentioned first embodiment is made in an annular form, a heat exchanger HE of the second embodiment is made in a rectangular parallelepiped form. Although the structures of first heat transfer plates 41 and second heat transfer plates 42 are substantially the same as those in the first embodiment, whereas the first and second heat transfer plates 41 and 42 of the first embodiment are involutely curved, the first and second heat transfer plates 41 and 42 of the second embodiment are made in the form of flat plates.

One edge of the alternately stacked first and second heat transfer plates 41 and 42 is joined to an end plate 43' corresponding to the outer casing 43, and the other edge thereof is joined to an end plate 44' corresponding to the inner casing 44. Furthermore, a pair of side plates 71 and 72 are joined to opposite sides in the stacking direction of the first and second heat transfer plates 41 and 42. Since the edges of the first and second heat transfer plates 41 and 42 intersect the two end plates 43' and 44' perpendicularly, they can be joined with the same structure as that of the joining part between the edge of the first and second heat transfer plates 41 and 42 and the inner casing 43 in the first embodiment (see FIG. 9). A high temperature combustion gas flows in through a combustion gas inlet 21 at the front end of the heat exchanger HE and flows out through a combustion gas outlet 22 at the rear end, and low temperature compressed air flows in through a compressed air inlet 19 formed at the rear end of one of the end plates 43' and flows out through a compressed air outlet 20 formed at the front end of the other end plate 44'.

In this way, the second embodiment can exhibit the same effects as those of the first embodiment and, moreover, the heat exchanger HE can be made compact.

Although embodiments of the present invention are described in detail above, the present invention can be modified in various ways without departing from the spirit and the scope thereof.

INDUSTRIAL APPLICABILITY

As hereinbefore described, the heat exchanger according to the present invention is suitably used for a gas turbine engine, but it can be used for any purpose, and is not limited to the gas turbine engine.

What is claimed is:

1. A heat exchanger comprising:

first heat transfer plates (41) having a plurality of first ridges (45) formed on one side and second heat transfer plates (42) having a plurality of second ridges (48) formed on one side, the first heat transfer plates (41) and the second heat transfer plates (42) being alternately superimposed;

low pressure fluid passages (62) formed and partitioned by the plurality of first ridges (45) between said one side of the first heat transfer plates (41) and the other side of the second heat transfer plates (42), the low pressure fluid passages (62) extending in the longitudinal direction of the first and second heat transfer plates (41, 42); and high pressure fluid passages (63) formed and partitioned by the plurality of second ridges (48) between said one side of the second heat transfer plates (42) and the other side of the first heat transfer plates (41), the high pressure fluid passages (63) having main fluid passages (64) defined by main ridges (49) extending in the longitudinal direction of the first and second heat transfer plates (41, 42), and inlet fluid passages **(65*a*, 65*b*) defined by inlet ridges (50*a*, 50*b*, 50*c*) extending in a direction perpendicular to the longitudinal direction of the first and second heat transfer plates (41, 42)**;

wherein a plurality of the inlet ridges **(50*a*, 50*b*, 50*c*) are formed at different intervals, and gaps ($\alpha$, $\beta$) are formed between the downstream ends of the inlet ridges (50*a*, 50*b*, 50*c*) and upstream ends of the main ridges (49) and wherein the upstream ends of the main ridges (49) are positioned irregularly offset with respect to each other in the longitudinal direction of the plates (41, 24)**.

2. The heat exchanger according to claim 1 wherein the high pressure fluid passages (63) further comprise outlet fluid passages **(66*a*, 66*b*) defined by a plurality of outlet ridges (51*a*, 51*b*, 51*c*) extending in a direction perpendicular to the longitudinal direction of the first and second heat transfer plates (41, 42), the plurality of outlet ridges (51*a*, 51*b*, 51*c*) being connected to the main ridges (49) defining the main fluid passages (64)**.

3. The heat exchanger according to claim 1, wherein the high pressure fluid passages (63) further comprise outlet fluid passages **(66*a*, 66*b*) defined by a plurality of outlet ridges (51*a*, 51*b*, 51*c*) extending in a direction perpendicular to the longitudinal direction of the first and second heat transfer plates (41, 42), the main fluid passages (64), which are sandwiched between the inlet fluid passages (65*a*, 65*b*) and the outlet fluid passages (66*a*, 66*b*)**, having a substantially parallelogramic shape.

4. A heat exchanger comprising:

first heat transfer plates (41) having a plurality of parallel first ridges (45) formed on one side by continuously bending the plates at predetermined intervals and making the bent parts come into intimate contact and second heat transfer plates (42) having a plurality of second ridges (48) formed on one side of the plates, the number of second ridges (48) being fewer than the number of first ridges (45), and the first heat transfer plates (41) and the second heat transfer plates (42) being alternately superimposed;

wherein low pressure fluid passages (62) are formed and partitioned by the plurality of first ridges (45) between said one side of the first heat transfer plates (41) and the other side of the second heat transfer plates (42), and high pressure fluid passages (63) are formed and partitioned by the plurality of second ridges (48) between said one side of the second heat transfer plates (42) and the other side of the first heat transfer plates (41);

wherein joining parts (46, 47) formed by bending opposite edges of the first heat transfer plates (41) toward said one side thereof are superimposed on and joined to joining parts (56, 57) formed by bending opposite edges of the second heat transfer plates (42) toward said other side thereof; and wherein casing members (43, 44) are joined to the mutually superimposed and joined joining parts (46, 47, 56, 57) of the first and second heat transfer plates (41, 42) respectively so as to provide a seal.

5. The heat exchanger according to claim 4, wherein the first heat transfer plates (41) and the second heat transfer plates (42) are stacked in an annular shape, a front outer ring (58) and a front inner ring (60) are respectively fixed to radially outer edges and radially inner edges at axially front ends of the mutually superimposed and joined joining parts (46, 47, 56, 57) of the first and second heat transfer plates (41, 42), a rear outer ring (59) and a rear inner ring (61) are respectively fixed to radially outer edges and radially inner edges at axially rear ends of the mutually superimposed and joined joining parts (46, 47, 56, 57) of the first and second heat transfer plates (41, 42), and as said casing members, an outer casing (43) and an inner casing (44) are then joined to the radially outer edges and the radially inner edges respectively of the first and second heat transfer plates (41, 42).

6. The heat exchanger according to claim 5 wherein the first heat transfer plates (41) and the second heat transfer plates (42) are involutely curved.

7. The heat exchanger according to claim 6 wherein the joining parts (46, 56) of the radially inner edges of the first and second heat transfer plates (41, 42) are made to follow the outer peripheral surface of the inner casing (44), and the joining parts (47, 57) of the radially outer edges of the first and second heat transfer plates (41, 42) are made to follow the inner peripheral surface of the outer casing (43).

8. The heat exchanger according to claim 7 wherein the radially inner edges of the first and second heat transfer plates (41, 42) are made perpendicular to the outer peripheral surface of the inner casing (44).

9. The heat exchanger according to claim 4 wherein the first heat transfer plates (41) and the second heat transfer plates (42) are made in the form of flat plates and stacked in a rectangular parallelepiped shape.

* * * * *